US011280058B2

(12) United States Patent
Nakano et al.

(10) Patent No.: US 11,280,058 B2
(45) Date of Patent: Mar. 22, 2022

(54) WORK MACHINE

(71) Applicant: HITACHI CONSTRUCTION MACHINERY CO., LTD., Tokyo (JP)

(72) Inventors: Hisami Nakano, Tsuchiura (JP); Hiroaki Tanaka, Kasumigaura (JP); Takaaki Chiba, Kasumigaura (JP); Hidekazu Moriki, Mito (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 198 days.

(21) Appl. No.: 16/642,080

(22) PCT Filed: Nov. 16, 2018

(86) PCT No.: PCT/JP2018/042579

§ 371 (c)(1),
(2) Date: Feb. 26, 2020

(87) PCT Pub. No.: WO2019/123927

PCT Pub. Date: Jun. 27, 2019

(65) Prior Publication Data

US 2020/0181870 A1 Jun. 11, 2020

(30) Foreign Application Priority Data

Dec. 22, 2017 (JP) ..... JP2017-246908

(51) Int. Cl.
*E02F 3/43* (2006.01)
*E02F 3/32* (2006.01)
(Continued)

(52) U.S. Cl.
CPC ..... *E02F 3/435* (2013.01); *E02F 3/32* (2013.01); *E02F 9/2025* (2013.01); *E02F 9/265* (2013.01)

(58) Field of Classification Search
CPC ... E02F 3/32; E02F 3/435; E02F 3/437; E02F 9/2025; E02F 9/2203; E02F 9/262; E02F 9/265
See application file for complete search history.

(56) References Cited

U.S. PATENT DOCUMENTS 5,735,065 A * 4/1998 Yamagata ..... E02F 9/2033 37/348
5,835,874 A * 11/1998 Hirata ..... E02F 3/435 701/50

(Continued)

FOREIGN PATENT DOCUMENTS

JP 10-252094 A 9/1998
JP 2007-332563 A 12/2007

(Continued)

OTHER PUBLICATIONS

International Preliminary Report on Patentability received in corresponding International Application No. PCT/JP2018/042579 dated Jul. 2, 2020.

(Continued)

*Primary Examiner* — Tyler J Lee
(74) *Attorney, Agent, or Firm* — Mattingly & Malur, PC

(57) ABSTRACT

Provided is a work machine with which an operator can easily perform semi-automatic excavating shaping work at an intended excavation velocity. An information processing device calculates a target velocity of a work point at a predetermined position on a work implement on the basis of each of operation signals of operation devices, calculates a distance between the work point and a target surface on the basis of posture information of driven members and position information of the target surface, corrects a velocity component of the target velocity, the velocity component being perpendicular to the target surface, according to the distance such that the work point does not penetrate the target (Continued)

surface, and performs, before calculating the target velocity, weighting on each of the operation signals of the operation devices according to contribution to a velocity component of the work point, the velocity component being parallel to the target surface, on the basis of the posture information of the driven members and the position information of the target surface.

4 Claims, 12 Drawing Sheets

(51) Int. Cl.
*E02F 9/20* (2006.01)
*E02F 9/26* (2006.01)

(56) References Cited

U.S. PATENT DOCUMENTS

| | | | | |
|---|---|---|---|---|
| 6,098,322 | A | 8/2000 | Tozawa et al. | |
| 9,551,129 | B2 * | 1/2017 | Kami | E02F 9/265 |
| 9,976,285 | B2 * | 5/2018 | Padilla | E02F 9/264 |
| 2012/0216519 | A1 | 8/2012 | Peterson et al. | |
| 2014/0142817 | A1 | 5/2014 | Matsuyama | |
| 2014/0200776 | A1 * | 7/2014 | Matsuyama | E02F 9/264 701/50 |
| 2016/0097184 | A1 | 4/2016 | Matsuyama et al. | |
| 2016/0244950 | A1 * | 8/2016 | Kami | G01C 15/00 |
| 2016/0273186 | A1 * | 9/2016 | Kami | E02F 9/2296 |
| 2017/0241106 | A1 | 8/2017 | Kitajima | |
| 2018/0148905 | A1 | 5/2018 | Matsuyama et al. | |
| 2018/0266083 | A1 | 9/2018 | Narikawa et al. | |
| 2019/0218745 | A1 * | 7/2019 | Hashimoto | E02F 3/815 |

FOREIGN PATENT DOCUMENTS

| | | | |
|---|---|---|---|
| JP | 2013-124736 | A | 6/2013 |
| JP | 5548306 | B2 | 7/2014 |
| WO | 2012/166223 | A2 | 12/2012 |
| WO | 2014/167718 | A1 | 10/2014 |
| WO | 2017/104407 | A1 | 6/2017 |

OTHER PUBLICATIONS

International Search Report of PCT/JP2018/042579 dated Feb. 12, 2019.

Extended European Search Report dated Nov. 16, 2021, issued in corresponding European Application No. 18 89 1267.

* cited by examiner

WORK MACHINE

TECHNICAL FIELD

The present invention relates to a work machine, such as a hydraulic excavator.

BACKGROUND ART

To perform work using a work machine, such as a hydraulic excavator, a hitherto known control system performs excavating shaping work semi-automatically by operating the work machine, correcting the operator's operation, using three-dimensional design data of a terrain profile.

Patent Document 1, for example, discloses a control system for a construction machine. When an operator performs an operation involving an arm, the control system for a construction machine determines that the operator attempts to perform shaping work and causes a boom to automatically operate so as to offset a velocity component perpendicular to a target surface of design data of a bucket distal end velocity resulting from the arm operation (hereinafter referred to as a perpendicular velocity).

The control system enables, in work involving excavation of a horizontal target surface disposed ahead of a machine body (leveling work), the operator to perform the excavating shaping work of the target surface through an operation of the arm only. Additionally, the operator can perform the semi-automatic excavating shaping work at an intended velocity by adjusting a velocity component parallel to the target surface of the bucket distal end velocity resulting from the arm operation (hereinafter referred to as an excavation velocity) such that rough excavation, in which a greater emphasis is placed on an amount of work done than on accuracy, is performed at a high velocity and finish excavation that requires higher accuracy is performed at a low velocity. This is because the excavation velocity is higher than the perpendicular velocity in an arm operation and the excavation velocity is lower than the perpendicular velocity in a boom operation, and the excavation velocity varies mainly depending on the arm operating velocity.

PRIOR ART DOCUMENT

Patent Document

Patent Document 1: Japanese Patent No. 5548306

SUMMARY OF THE INVENTION

Problem to be Solved by the Invention

The work machine incorporating the control system disclosed in Patent Document 1 can, however, impair excavating shaping accuracy because of difficulties involved in performing the semi-automatic excavating shaping work at a velocity intended by the operator, depending on a positional relation between the machine body and the target surface.

When a vertical target surface ahead of the machine body is to be excavated, for example, operating the arm in a pull direction as in leveling work causes the bucket to depart from the target surface, thus disabling excavating. Operating the arm in a push direction opposite from the pull direction causes the bucket distal end velocity to be oriented upward, opposite from an excavating direction. In addition, the perpendicular velocity by the arm operation is higher than in the leveling work. Thus, even a slight variation in an operation amount of the arm results in a great variation in the perpendicular velocity. Meanwhile, the bucket distal end velocity by a boom lowering operation is oriented downward and coincides with the excavating direction, and the excavation velocity varies according to the boom operating velocity. Additionally, the perpendicular velocity by the boom lowering operation is lower than in the leveling work. The boom velocity thus varies greatly in order to offset the great variation in the perpendicular velocity occurring as a result of the variation in the operation amount of the arm. Accordingly, the variation in the excavation velocity increases, which makes it difficult for the operator to perform the semi-automatic excavating shaping work at the intended velocity, leading to impaired excavating shaping accuracy.

The present invention has been made to solve the foregoing problem, and it is an object of the present invention to provide a work machine that enables an operator to easily perform semi-automatic excavating shaping work at an intended excavation velocity.

Means for Solving the Problem

To achieve the foregoing object, the present invention provides a work machine, including: a machine body; a work implement mounted rotatably on the machine body and including a plurality of driven members connected rotatably with each other; a plurality of actuators driving the plurality of driven members; a plurality of operation devices for operating the plurality of driven members; a posture detection device detecting a posture of the machine body and the plurality of driven members; a design data input device for inputting design surface information; and an information processing device controlling driving of the plurality of actuators in response to each of operation signals of the plurality of operation devices, the information processing device extracting position information of a target surface that serves as a work object from the design surface information, calculating a target velocity of a work point at a predetermined position on the work implement using each of the operation signals of the plurality of operation devices, calculating a distance between the work point and the target surface on the basis of posture information of the plurality of driven members and position information of the target surface, and correcting a velocity component perpendicular to the target surface of the target velocity according to the distance such that the work point does not penetrate the target surface. In the work machine, the information processing device performs, before calculating the target velocity, weighting on each of the operation signals of the plurality of operation devices according to contribution of the work point to a velocity component parallel to the target surface on the basis of the posture information of the plurality of driven members and the position information of the target surface.

In accordance with the present invention having the configurations as described above, weighting is performed on each of the operation signals of the operation devices such that a weight on the operation signal of the actuator contributing greatly to the excavation velocity (velocity component parallel to the target surface) increases and a weight on the operation signal of the actuator contributing slightly to the excavation velocity decreases, before the target velocity of the work point at a predetermined position on the work implement is calculated. Through the foregoing weighting, the correction according to the distance between the target surface and the work point is performed mainly on the operation signal of the actuator contributing slightly to the excavation velocity and the correction on the operation signal of the actuator contributing greatly to the excavation velocity is suppressed, so that the operator can easily perform semi-automatic excavating shaping work at the intended excavation velocity.

Advantages of the Invention

The work machine in accordance with the present invention enables the operator to easily perform the semi-automatic excavating shaping work at an intended excavation velocity.

MODES FOR CARRYING OUT THE INVENTION

Figure 1:
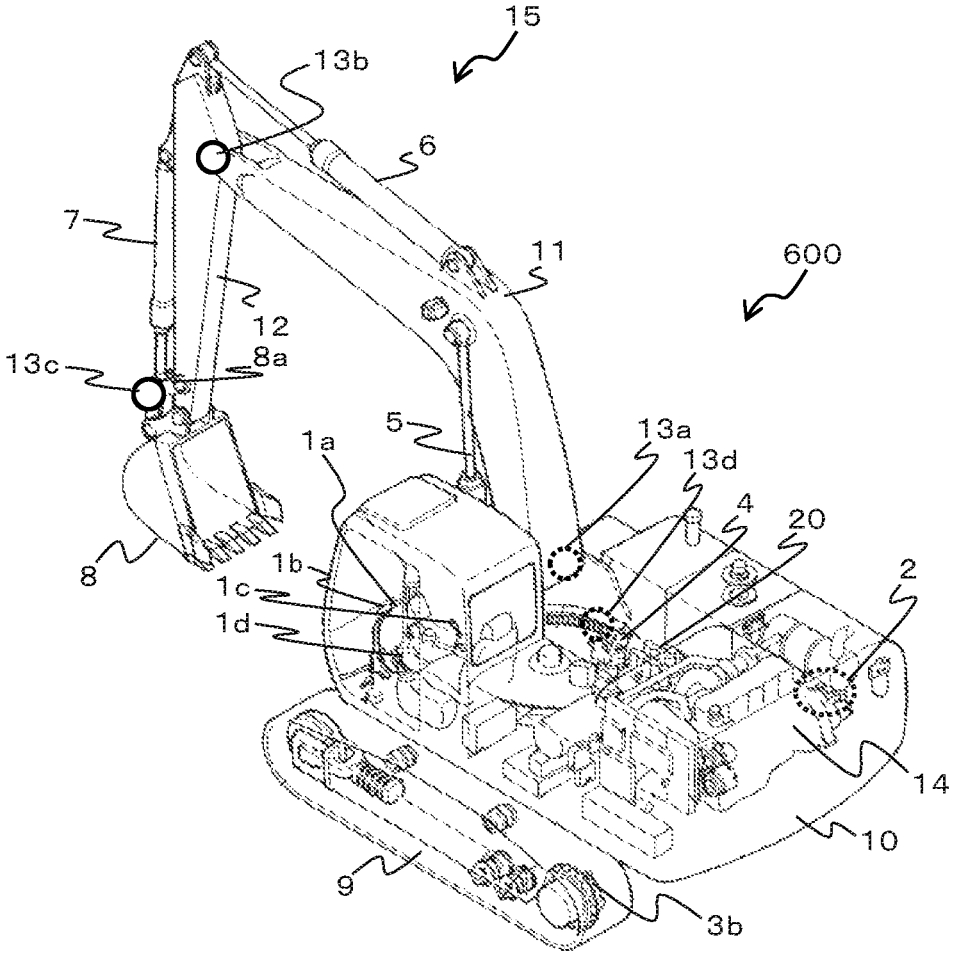
FIG. 1 is a perspective view of a hydraulic excavator as an example of a work machine according to a first embodiment of the present invention.

Embodiments of the present invention will be described below with reference to the accompanying drawings and using a hydraulic excavator as a work machine according to the embodiments of the present invention. In the drawings, like or corresponding parts are identified by identical reference numerals and descriptions for those parts will be omitted as appropriate.

First Embodiment

FIG. 1 is a perspective view of a hydraulic excavator according to a first embodiment of the present invention. As illustrated in FIG. 1, a hydraulic excavator 600 includes, as a machine body, a lower track structure 9, an upper swing structure 10, and a work implement 15. The lower track structure 9 includes left and right crawler type track devices and is driven by left and right track hydraulic motors 3*b* (only the left track hydraulic motor is illustrated). The upper swing structure 10 is mounted swingably on the lower track structure 9 and is swingably driven by a swing hydraulic motor 4. The upper swing structure 10 includes an engine 14 as a prime mover, a hydraulic pump unit 2, which is driven by the engine 14, and a control valve 20, which will be described later.

The work implement 15 is mounted at a front portion of the upper swing structure 10 rotatably in a vertical direction. The upper swing structure 10 includes a cab. A track right operation lever device 1*a*, a track left operation lever device 1*b*, and operation devices are disposed inside the cab. The operation devices are intended for directing an operation of the work implement 15 and a swing operation of the upper swing structure 10. The operation devices include a right operation lever device 1*c* and a left operation lever device 1*d*.

The right operation lever device 1*c* outputs, for example, a signal directing an operation of a boom 11 (boom operation signal) in response to a lever operation in a fore-aft direction. The right operation lever device 1*c* outputs, for example, a signal directing an operation of a bucket 8 (bucket operation signal) in response to a lever operation in a left-right direction. Specifically, the right operation lever device 1*c* in the present embodiment constitutes a boom operation device for operating the boom 11 and a bucket operation device for operating the bucket 8.

The left operation lever device 1*d* outputs, for example, a signal directing an operation of the upper swing structure 10 (swing operation signal) in response to a lever operation in the fore-aft direction. The left operation lever device 1*d* outputs, for example, a signal directing an operation of an arm 12 (arm operation signal) in response to a lever operation in the left-right direction. Specifically, the left operation lever device 1*d* in the present embodiment constitutes a swing operation device for operating the upper swing structure 10 and an arm operation device for operating the arm 12.

The work implement 15 has an articulated structure and includes the boom 11, the arm 12, and the bucket 8 that serve as driven members connected rotatably with respect to each other. The boom 11 is connected with a front side of the upper swing structure 10 rotatably in the vertical direction. The arm 12 is connected with a distal end portion of the boom 11 rotatably in the vertical or fore-aft direction. The bucket 8 is connected with a distal end portion of the arm rotatably in the vertical or fore-aft direction. The boom 11 rotates with respect to the upper swing structure 10 in the vertical direction through extension and contraction of a boom cylinder 5. The arm 12 rotates with respect to the boom 11 in the vertical or fore-aft direction through extension and contraction of an arm cylinder 6. The bucket 8 rotates with respect to the arm 12 in the vertical or fore-aft direction through extension and contraction of a bucket cylinder 7.

To compute a position of any point in the work implement 15, the hydraulic excavator 600 includes a first posture sensor 13*a*, a second posture sensor 13*b*, a third posture sensor 13*c*, and a machine body posture sensor 13*d*. The first posture sensor 13*a* is disposed near a connection portion between the upper swing structure 10 and the boom 11 and detects an angle of the boom 11 relative to a horizontal plane (boom angle). The second posture sensor 13*b* is disposed near a connection portion between the boom 11 and the arm 12 and detects an angle of the arm 12 relative to the horizontal plane (arm angle). The third posture sensor 13*c* is disposed at a bucket link 8*a*, which connects the arm 12 with the bucket 8, and detects an angle of the bucket link 8*a* relative to the horizontal plane (bucket angle). The machine body posture sensor 13*d* detects inclination angles (a roll angle and a pitch angle) of the upper swing structure 10 relative to the horizontal plane. It is noted that the first posture sensor 13*a* to the third posture sensor 13*c* may each be a sensor detecting a relative angle.

The angles detected by the posture sensors 13*a* to 13*d* are input as posture signals to an information processing device 100, which will be described later. The posture sensors 13*a* to 13*d* constitute a posture detection device that detects a posture of the machine body and the work implement 15 of the hydraulic excavator 600.

The control valve 20 controls flow (flow rate and direction) of hydraulic fluid to be supplied from the hydraulic pump unit 2 to each of actuators including the swing hydraulic motor 4, the boom cylinder 5, the arm cylinder 6, the bucket cylinder 7, and the left and right track hydraulic motors 3*b*.

Figure 2:
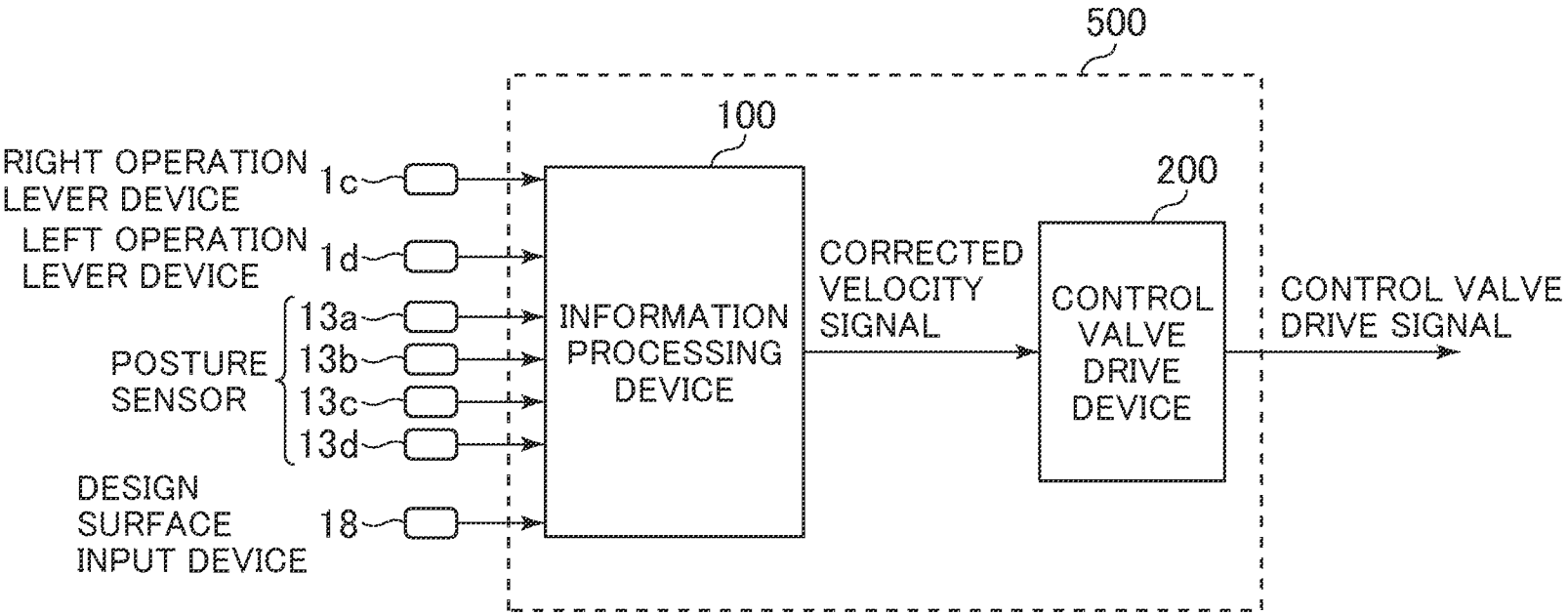
FIG. 2 is a configuration diagram of a control system mounted in the hydraulic excavator illustrated in FIG. 1.

FIG. 2 is a configuration diagram of a control system mounted in the hydraulic excavator 600. As illustrated in FIG. 2, this control system 500 includes the information processing device 100 and a control valve drive unit 200. The information processing device 100 generates a corrected velocity signal used for moving a work point at a predetermined position on the work implement 15 (e.g., a bucket distal end) along a target surface. The control valve drive unit 200 generates a drive signal for the control valve 20 according to the corrected velocity signal. The information processing device 100 includes hardware including, for example, a CPU (Central Processing Unit) not illustrated, a storage device that stores various types of programs for enabling the CPU to perform processing, such as a ROM (Read Only Memory) and a HDD (Hard Disc Drive), and a RAM (Random Access Memory) that serves as a work space for the CPU to perform the program.

The information processing device 100 receives a boom operation signal and a bucket operation signal from the right operation lever device 1*c*, receives a swing operation signal and an arm operation signal from the left operation lever device 1*d*, receives first posture information, second posture information, third posture information, and machine body posture information from the first posture sensor 13*a*, the second posture sensor 13*b*, the third posture sensor 13*c*, and the machine body posture sensor 13*d*, respectively, and receives design surface information from a design data input device 18. The information processing device 100 then calculates a corrected velocity signal and transmits the corrected velocity signal to the control valve drive unit 200. The control valve drive unit 200 generates a control valve drive signal according to the corrected velocity signal to thereby drive the control valve 20.

Figure 3:
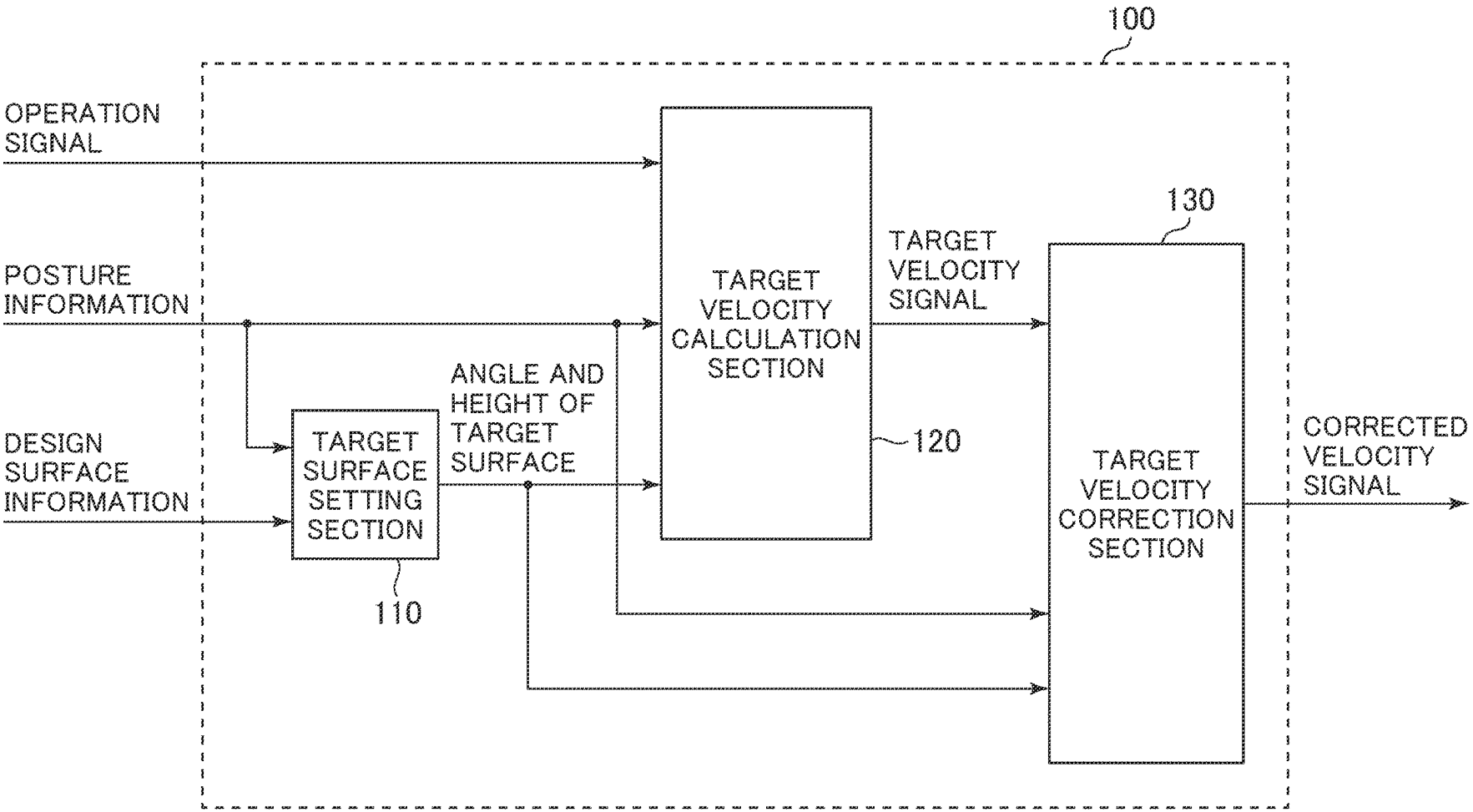
FIG. 3 is a functional block diagram of an information processing device illustrated in FIG. 2.

FIG. 3 is a functional block diagram of the information processing device 100 illustrated in FIG. 2. As illustrated in FIG. 3, the information processing device 100 includes a target surface setting section 110, a target velocity calculation section 120, and a target velocity correction section 130. The following outlines the target surface setting section 110 and the target velocity correction section 130, which incorporate well-known techniques, and details the target velocity calculation section 120.

The target surface setting section 110 extracts position information of the target surface that serves as a work object from the design surface information input from the design data input device 18 so as to be compatible with the position information from the posture sensors 13*a* to 13*d*. The target surface setting section 110 then outputs the position information to the target velocity calculation section 120 and the target velocity correction section 130. It is noted that, in extracting the position information of the target surface that serves as the work object, the target surface setting section 110 may assume, as the target surface, a design surface disposed vertically downward with respect to a distal end of the work implement 15 or, when no design surface exists vertically downward with respect to the distal end of the work implement 15, a design surface anterior to or posterior to the distal end of the work implement 15.

Figure 8:
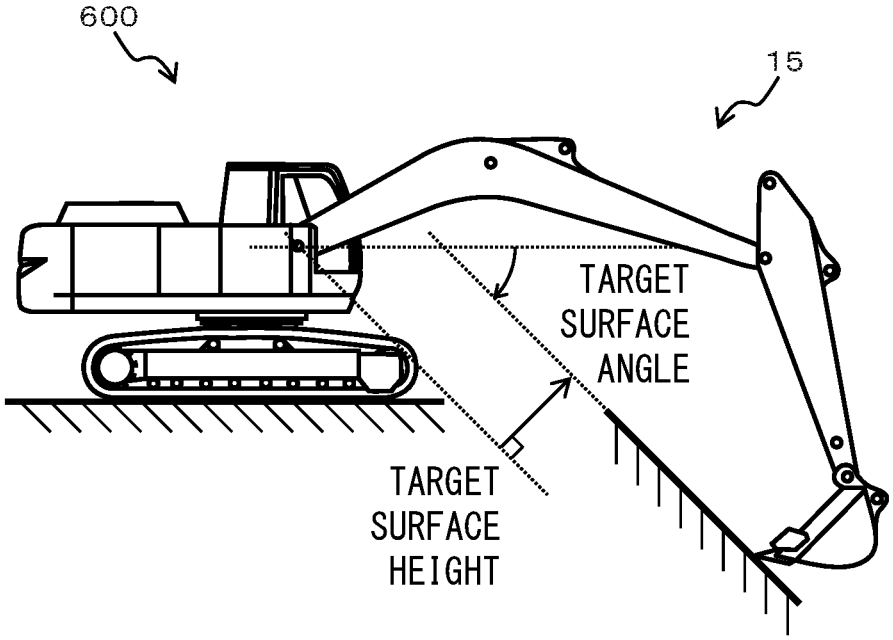
FIG. 8 is a diagram for illustrating a target surface angle and a target surface height representing a target surface.

The target surface is represented by an angle and a height. Reference is now made to FIG. 8, which illustrates a positional relation between the target surface and the machine body. The target surface angle is defined as an angle of the target surface relative to an anterior direction of the machine body. The target surface height is defined as a perpendicular distance from a center of rotation of the boom 11 to the target surface.

Figure 4:
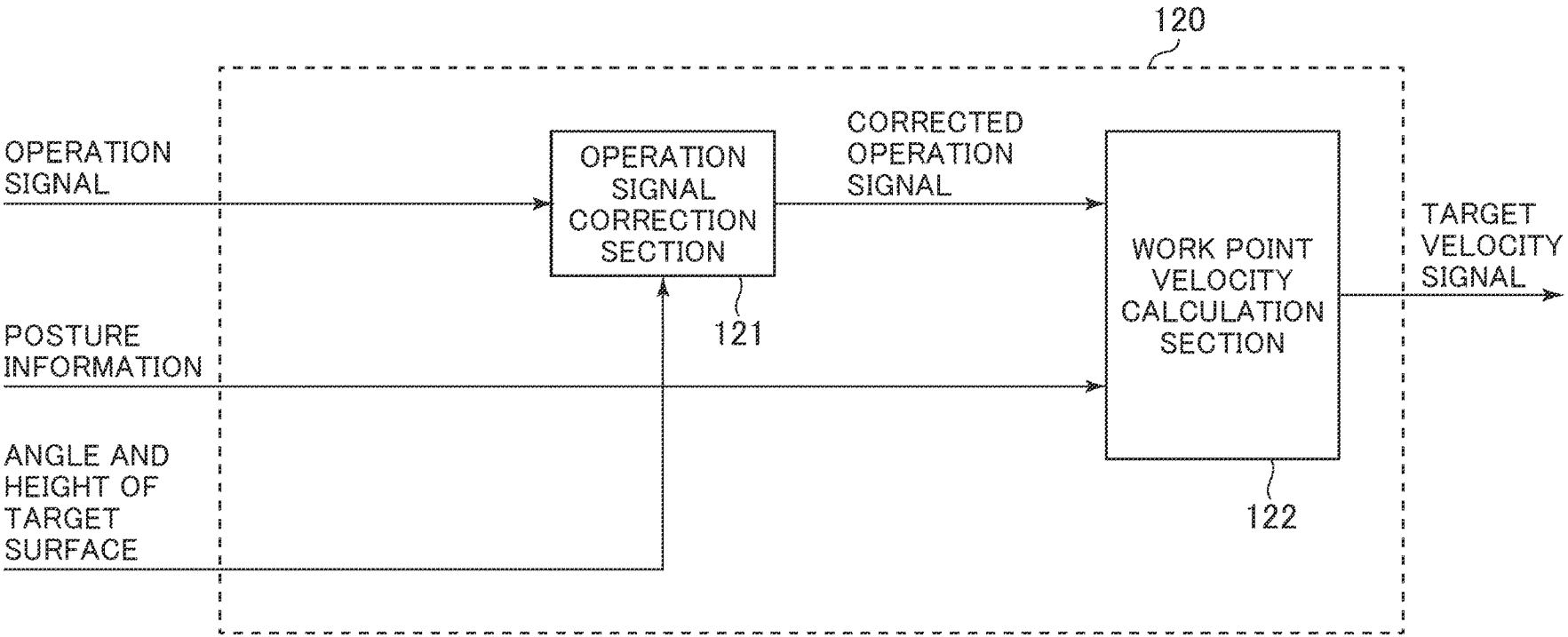
FIG. 4 is a functional block diagram of a target velocity calculation section illustrated in FIG. 3.

FIG. 4 is a functional block diagram of the target velocity calculation section 120 in the present embodiment. As illustrated in FIG. 4, the target velocity calculation section 120 includes an operation signal correction part 121 and a work point velocity calculation part 122. The target velocity calculation section 120 calculates a target velocity signal so as to be compatible with the operation signal, the posture information, and the position information (an angle and a height) of the target surface and outputs the target velocity signal. The operation signal correction part 121 determines a correction factor k ($0 \leq k \leq 1$) so as to be compatible with the angle and the height of the target surface on the basis of a predetermined data table (hereinafter referred to as a correction factor determination table). The operation signal correction part 121 then multiplies the operation signal of the arm 12 by the correction factor k, multiplies the operation signal of the boom 11 by (1−k), and outputs the result as a corrected operation signal.

Figure 5:
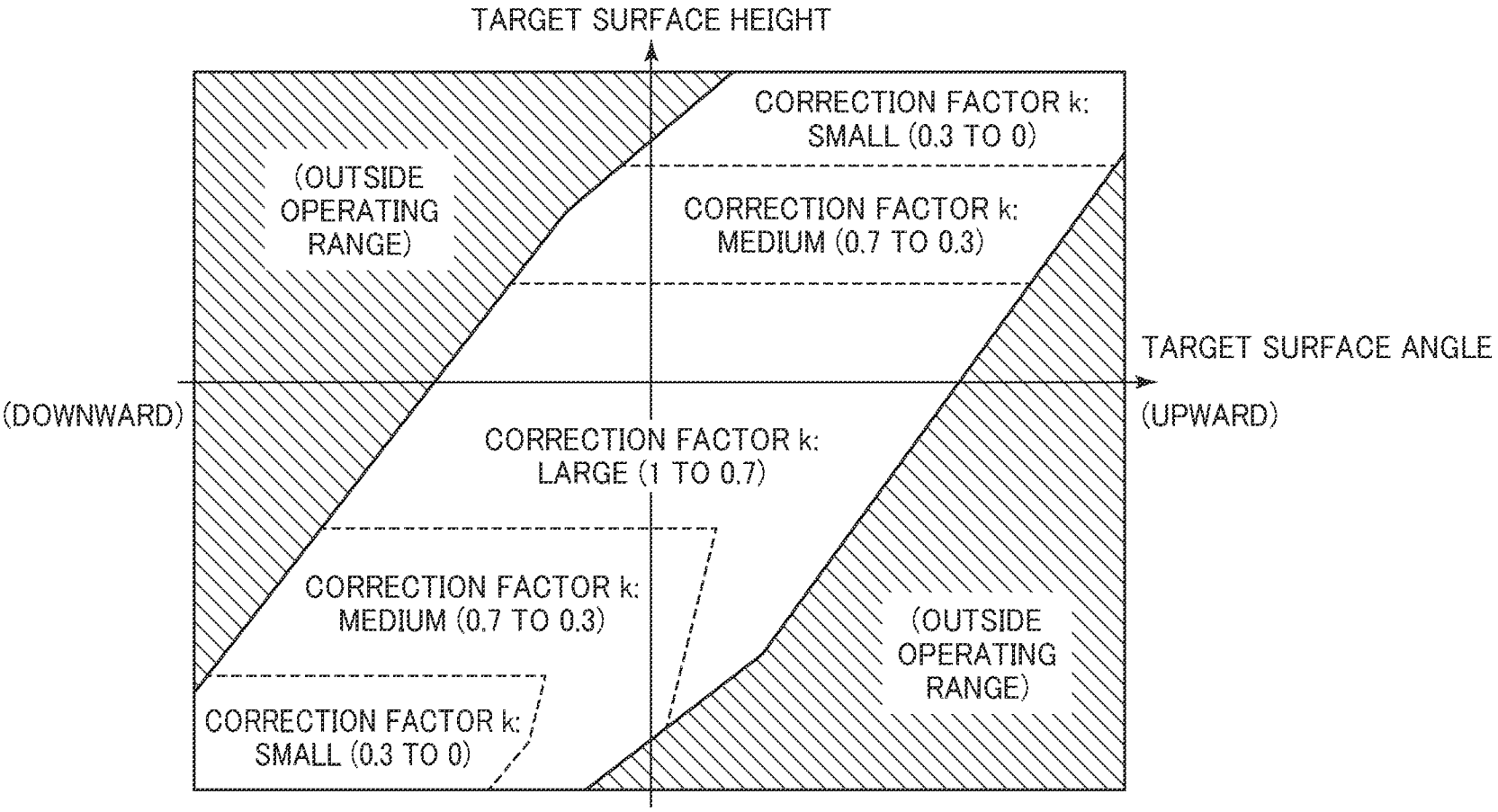
FIG. 5 is a diagram illustrating an example of a correction factor determination table used by an operation signal correction part illustrated in FIG. 4.

FIG. 5 is a diagram illustrating an example of the correction factor determination table. As illustrated in FIG. 5, the correction factor k approaches 1 as absolute values of the target surface angle and of the target surface height decrease, so that the arm operation signal contributes greatly to the target velocity and the boom operation signal contributes slightly to the target velocity. On the other hand, the correction factor k approaches 0 as absolute values of the target surface angle and of the target surface height increase, so that the boom operation signal contributes greatly to the target velocity and the arm operation signal contributes slightly to the target velocity. The shaded areas in FIG. 5 represent ranges that are not to be reached by the work implement 15 and that cannot be defined as the work object. The ranges are thus not to be subjected to the correction.

Reference is made back to FIG. 4. The work point velocity calculation part 122 calculates a velocity occurring at the work point (e.g., bucket distal end) of the work implement 15 so as to be compatible with the corrected operation signal and the posture information and outputs the calculated velocity as the target velocity signal.

Reference is made back to FIG. 3. The target velocity correction section 130 makes correction, when the target velocity is in a direction of approaching the target surface, such that, out of the target velocity signal obtained from the target velocity calculation section 120, a component perpendicular to the target surface decreases depending on the distance from the target surface calculated using the posture information and the position information of the target surface. The permissible perpendicular component increases with a greater distance and decreases with a smaller distance. The work point of the work implement 15 can thereby be prevented from penetrating the target surface.

Operations of the hydraulic excavator 600 according to the present embodiment will be described with reference to FIGS. 9 to 12.

Figure 9:
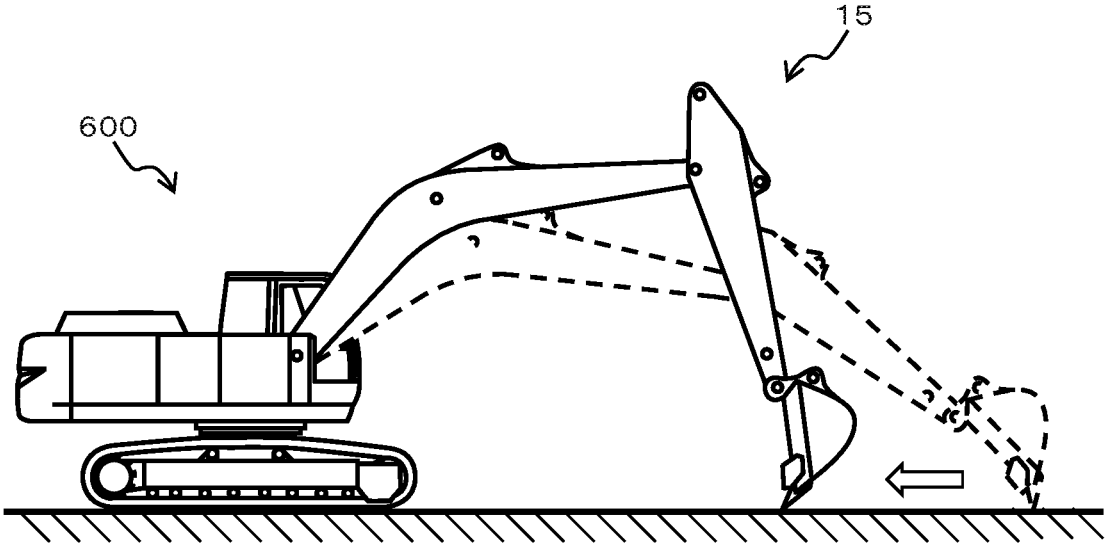
FIG. 9 is a diagram illustrating how the hydraulic excavator illustrated in FIG. 1 excavates a horizontal target surface disposed ahead of a machine body of the hydraulic excavator.
Figure 10:
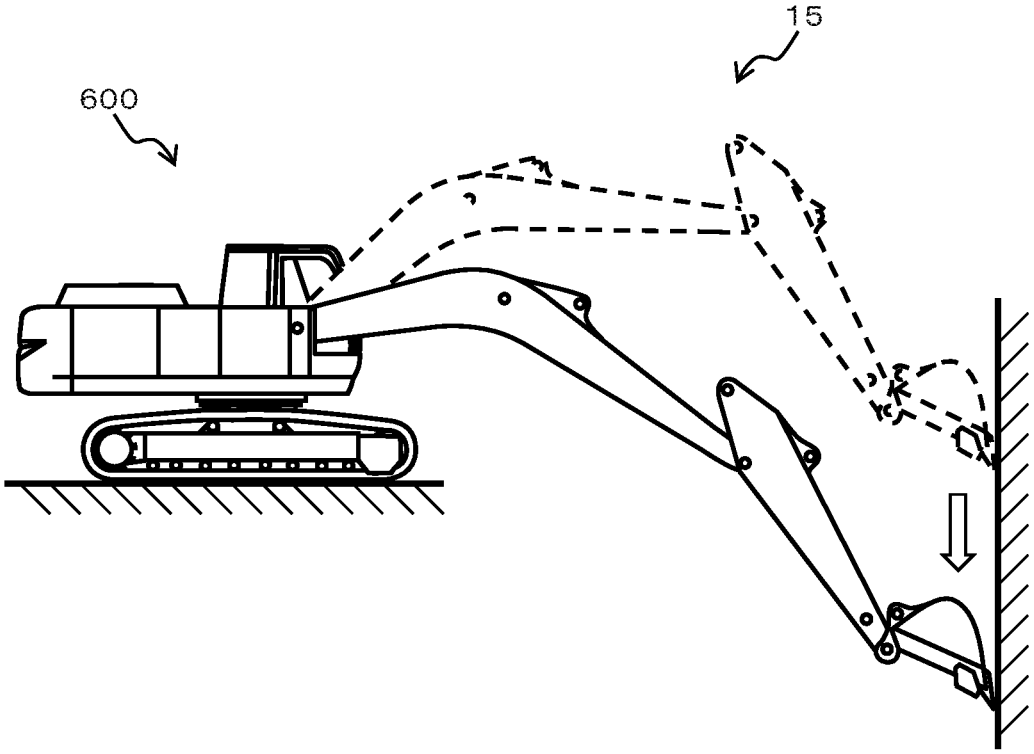
FIG. 10 is a diagram illustrating how the hydraulic excavator illustrated in FIG. 1 excavates a vertical target surface disposed ahead of a machine body of the hydraulic excavator.

FIG. 9 is a diagram illustrating how the hydraulic excavator 600 excavates a horizontal target surface disposed ahead of the machine body. FIG. 10 is a diagram illustrating how the hydraulic excavator 600 excavates a vertical target surface disposed ahead of the machine body.

Figure 11A:
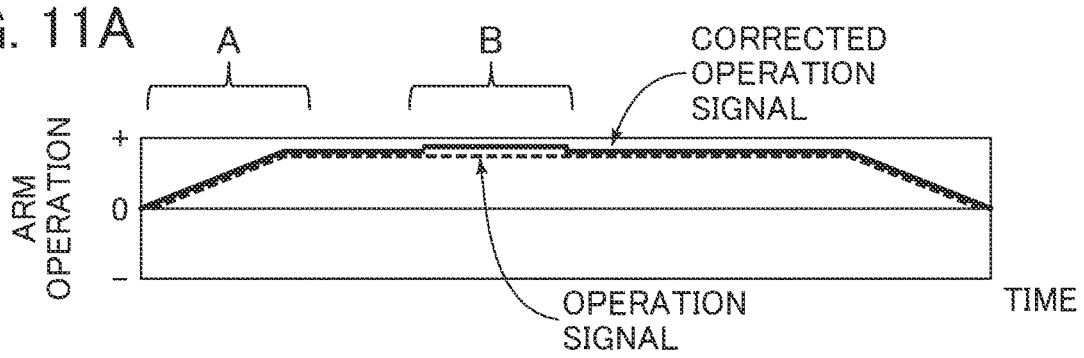
FIGS. 11A to 11E are schematic diagrams depicting changes with time of various signals when the hydraulic excavator illustrated in FIG. 1 performs the excavation operation illustrated in FIG. 9.
Figure 11B:
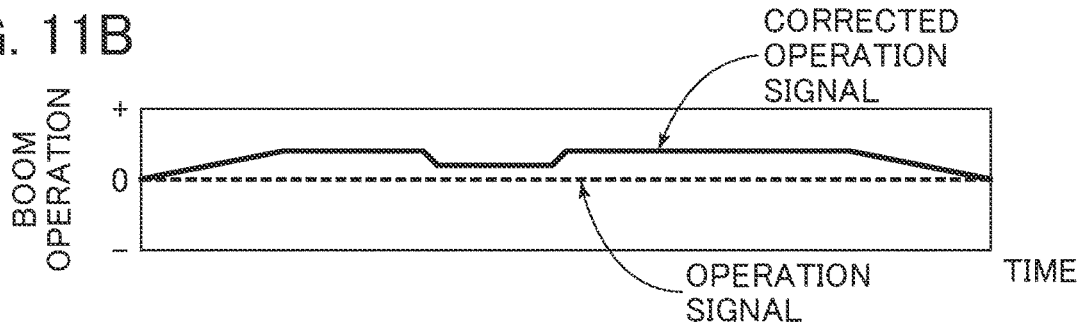
Figure 11C:
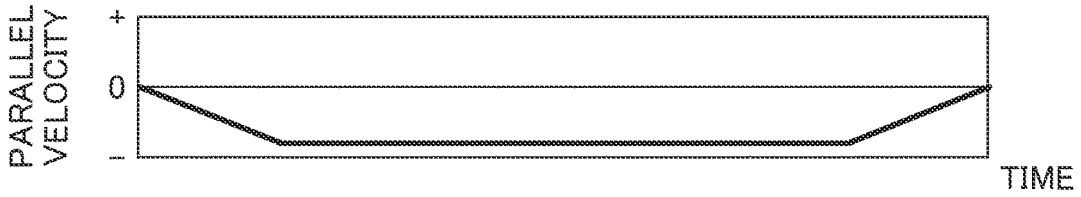
Figure 11D:
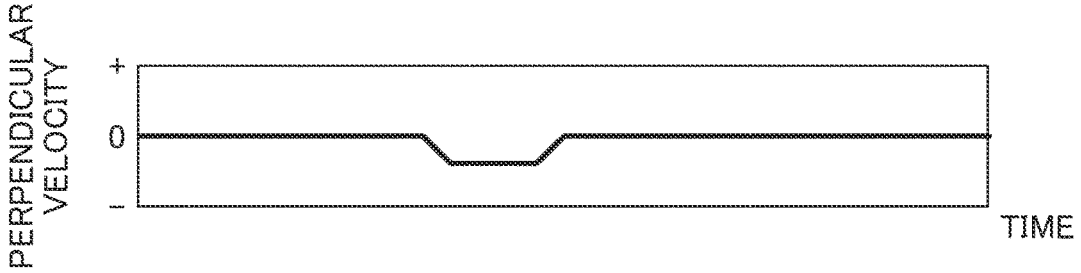
Figure 11E:
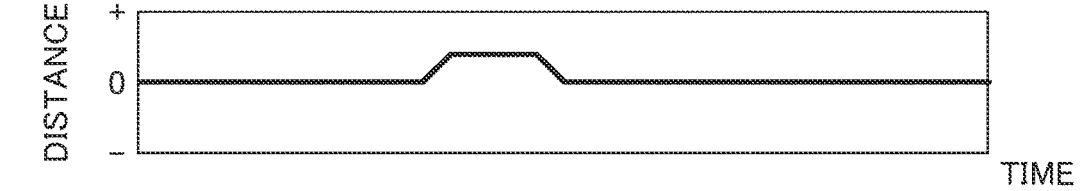
Figure 12A:
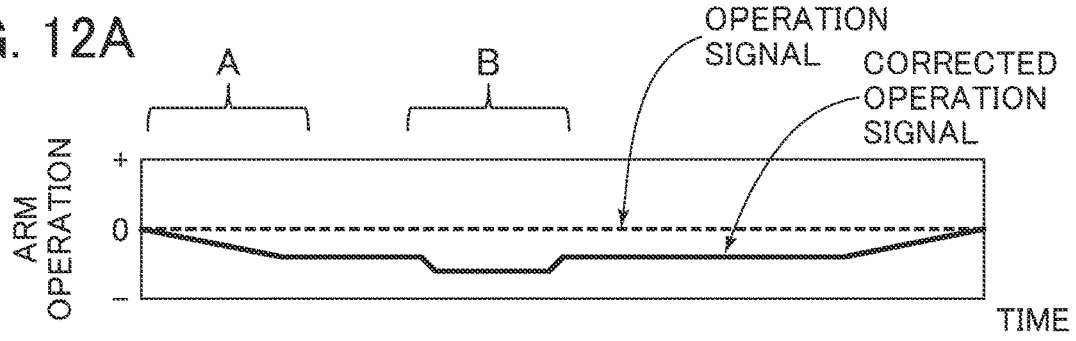
FIGS. 12A to 12E are schematic diagrams depicting changes with time of various signals when the hydraulic excavator illustrated in FIG. 1 performs the excavation operation illustrated in FIG. 10.
Figure 12B:
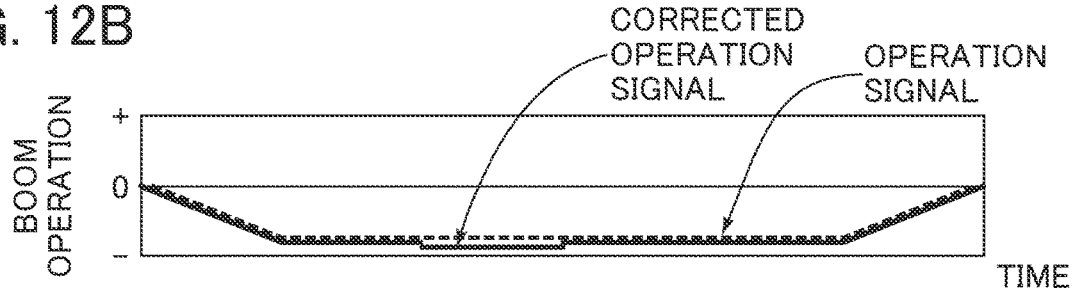
Figure 12C:
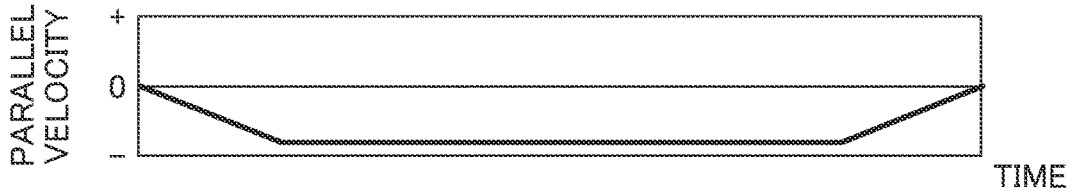
Figure 12D:
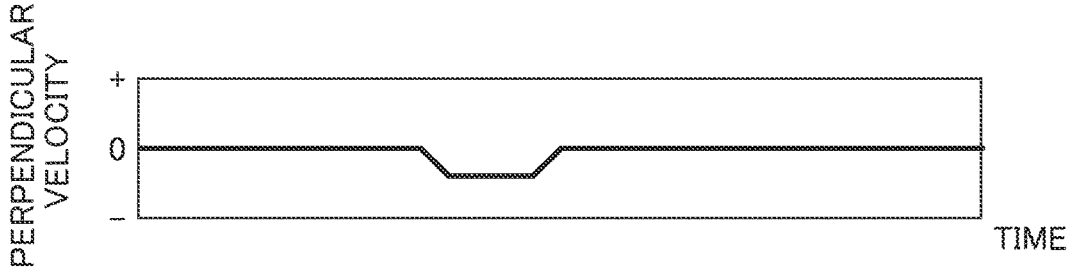
Figure 12E:
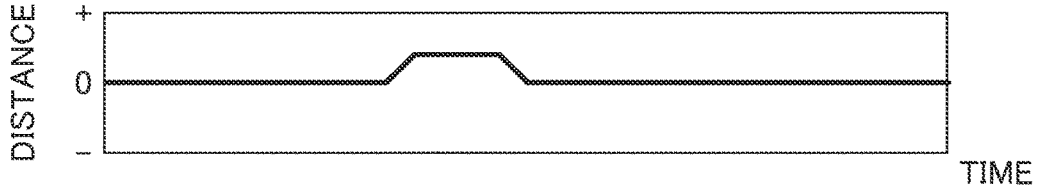

FIGS. 11A to 11E and FIGS. 12A to 12E are schematic diagrams depicting changes with time of various signals when the hydraulic excavator 600 performs the excavation operations illustrated in FIG. 9 and FIG. 10, respectively. FIGS. 11A and 12B each depict the operation signal and the corrected operation signal of the arm 12 (the dotted line denotes the operation signal and the solid line denotes the corrected operation signal). FIGS. 11B and 12B each depict the operation signal and the corrected operation signal of the boom 11 (the dotted line denotes the operation signal and the solid line denotes the corrected operation signal). FIGS. 11C and 12C each depict the velocity component parallel to the target surface out of the corrected velocity signal output from the target velocity correction section. FIGS. 11D and 12D each depict the velocity component perpendicular to the target surface out of the corrected velocity signal output from the target velocity correction section. FIGS. 11E and 12E each depict the distance between the work point and the target surface. In each of FIGS. 11A to 11E and FIGS. 12A to 12E, the horizontal axis represents time.

FIGS. 11A to 11E will be described. Section A in FIGS. 11A to 11E illustrates that the operation signal of the arm 12 increases to reach a constant level. In section A, as the arm operation signal increases as illustrated in FIG. 11A, the parallel velocity increases as illustrated in FIG. 11C and reaches a substantially constant level as the operation signal becomes constant. With the boom operation signal illustrated in FIG. 11B, the corrected operation signal (solid line) appears in order to offset the perpendicular velocity generated by the arm operation even with an input by the operator (dotted line) being zero.

Section B in FIG. 11A to 11E illustrates that the distance between the work point and the target surface increases for some reason. In section B, as the distance increases as illustrated in FIG. 11E, the corrected operation signal of the boom 11 decreases as illustrated in FIG. 11B. Additionally, the corrected operation signal of the arm 12 may slightly vary as illustrated in FIG. 11A depending on a parameter set in the target velocity correction section 130. As described above, in the excavation operation illustrated in FIG. 9, the excavation operation is performed at the parallel velocity corresponding to the operation signal of the arm 12, and a correction according to the distance between the target surface and the work point is performed mainly on the operation signal of the boom 11.

FIGS. 12A to 12E will be described. Section A in FIGS. 12A to 12E illustrates that the operation signal of the boom 11 decreases to reach a constant level. In section A, as the boom operation signal decreases as illustrated in FIG. 12A, the parallel velocity decreases as illustrated in FIG. 12C and reaches a substantially constant level as the operation signal becomes constant. With the arm operation illustrated in FIG. 12B, the corrected operation signal (solid line) appears in order to offset the perpendicular velocity generated by the boom operation even with an input by the operator (dotted line) being zero.

Section B in FIGS. 12A to 12E illustrates that the distance between the work point and the target surface increases for some reason. In section B, as the distance increases as illustrated in FIG. 12E, the corrected operation signal of the arm 12 decreases as illustrated in FIG. 12B. Additionally, the corrected operation signal of the arm 12 may slightly vary as illustrated in FIG. 12A depending on a parameter set in the target velocity correction section 130. As described above, in the excavation operation illustrated in FIG. 10, the excavation operation is performed at the parallel velocity corresponding to the operation signal of the boom 11, and a correction according to the distance between the target surface and the work point is performed mainly on the operation signal of the arm 12.

In accordance with the hydraulic excavator 600 according to the present embodiment having the configurations as described above, weighting is performed on each of the operation signals of the operation devices 1*c* and 1*d* such that a weight on the operation signal of the actuator contributing greatly to the excavation velocity (velocity component parallel to the target surface) increases and a weight on the operation signal of the actuator contributing slightly to the excavation velocity decreases, before the target velocity of the work point at a predetermined position on the work implement 15 (e.g., a bucket distal end) is calculated. Through the foregoing weighting, the correction according to the distance between the target surface and the work point is performed mainly on the operation signal of the actuator contributing slightly to the excavation velocity, and the correction on the operation signal of the actuator contributing greatly to the excavation velocity is suppressed, so that the operator can easily perform semi-automatic excavating shaping work at the intended excavation velocity.

Second Embodiment

A second embodiment of the present invention will be described with particular emphasis on differences from the first embodiment.

Figure 6:
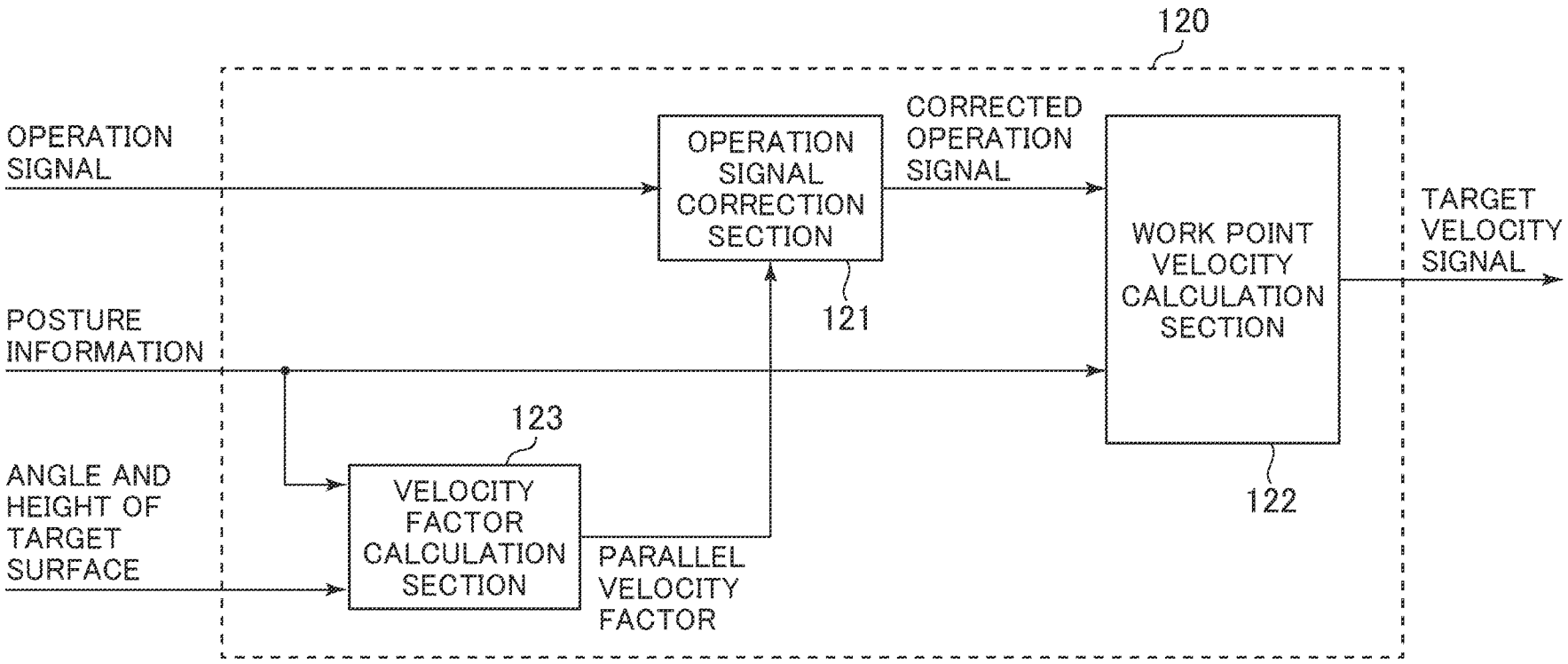
FIG. 6 is a functional block diagram of a target velocity calculation section in a second embodiment of the present invention.

FIG. 6 is a functional block diagram of a target velocity calculation section 120 in the present embodiment. In FIG. 6, the target velocity calculation section 120 includes a velocity factor calculation part 123, in addition to the components of the first embodiment (illustrated in FIG. 4).

The velocity factor calculation part 123 calculates, on the basis of the posture information of the work implement 15 and the position information (an angle and a height) of the target surface, a component parallel to the target surface of a velocity factor (hereinafter referred to as a parallel velocity factor), where the velocity factor serves as a ratio of the velocity of the work point to a value of the operation signal when each of the actuators is operated individually. The velocity factor calculation part 123 then outputs the component to an operation signal correction part 121.

The operation signal correction part 121 corrects each of the operation signals of the operation devices 1*c* and 1*d* according to the parallel velocity factor and outputs the corrected operation signal to a work point velocity calculation part 122. Let "ax" denote the parallel velocity factor of the arm 12, "bx" denote the parallel velocity factor of the boom 11, "as" denote the operation signal of the arm 12, and "bs" denote the operation signal of the boom 11, and append ' (prime) to the corrected operation signals. Then, calculations by the operation signal correction part 121 are given by the following expressions.

$$as'=as\times ax/(ax+bx) \quad \text{[Math. 1]}$$

$$bs'=bs\times bx/(ax+bx) \quad \text{[Math. 2]}$$

Through the foregoing corrections, the corrected operation signals are calculated such that a great weight is assigned to an actuator that contributes greatly to the velocity (parallel velocity) along the target surface of the work point. It is noted that the calculations performed by the operation signal correction part 121, given by expressions (1) and (2) above, are illustrative only and not limiting.

In accordance with the hydraulic excavator 600 according to the present embodiment having the configurations as described above, weighting is performed on each of the operation signals of the operation devices 1*c* and 1*d* according to the parallel velocity factor before the target velocity of the work point at a predetermined position on the work implement 15 (e.g., a bucket distal end) is calculated. Through the foregoing weighting, the correction according to the distance between the target surface and the work point is performed mainly on the operation signal of the actuator contributing slightly to the excavation velocity and the correction on the operation signal of the actuator contributing greatly to the excavation velocity is suppressed, so that the operator can easily perform semi-automatic excavating shaping work at the intended excavation velocity.

Third Embodiment

A third embodiment of the present invention will be described with particular emphasis on differences from the second embodiment.

Figure 7:
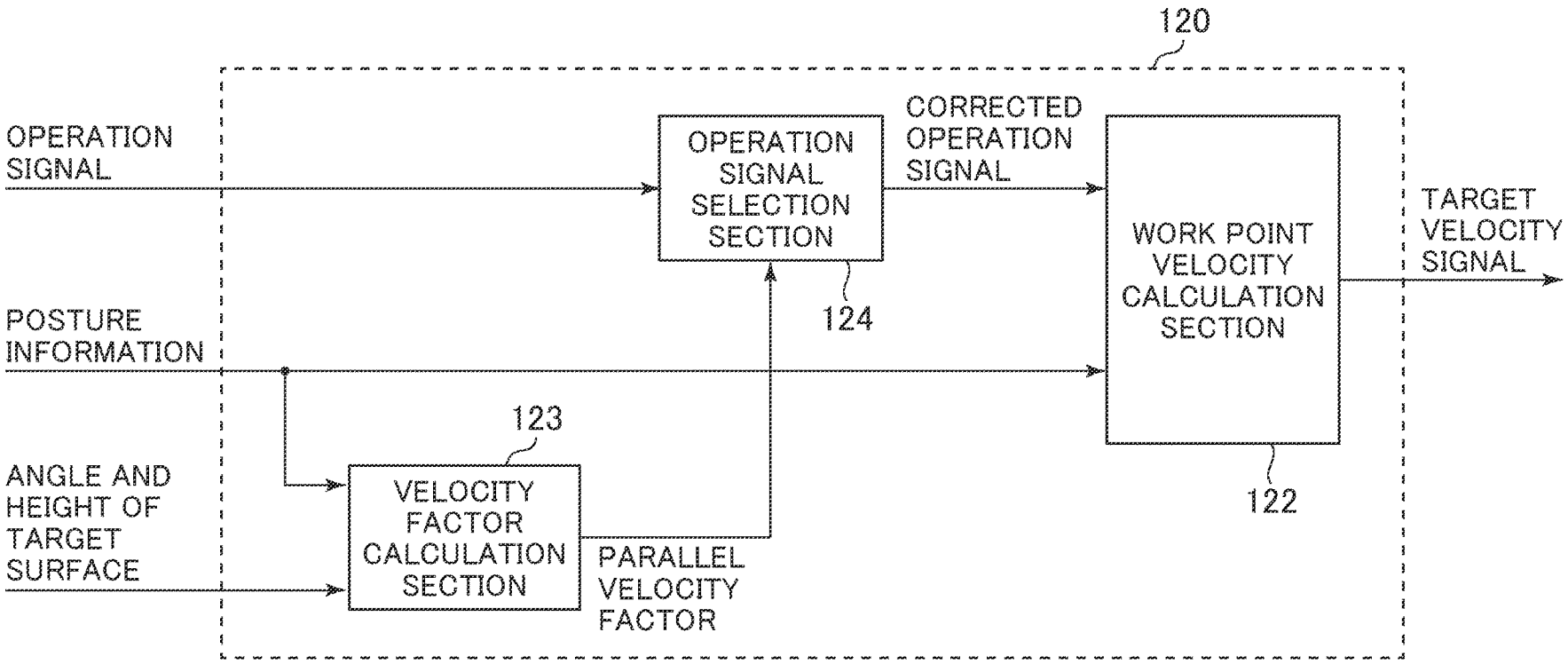
FIG. 7 is a functional block diagram of a target velocity calculation section in a third embodiment of the present invention.

FIG. 7 is a functional block diagram of a target velocity calculation section 120 in the present embodiment. In FIG. 7, the target velocity calculation section 120 includes an operation signal selection part 124 in place of the operation signal correction part 121 of the second embodiment (illustrated in FIG. 6).

The operation signal selection part 124 compares parallel velocity factors of the different actuators, and weighting is performed on each of the operation signals such that the weight on the operation signal of the actuator having the greatest parallel velocity factor is 1 and the weight on the operation signals of the other actuators is 0. As a result, in the excavation operation illustrated in FIG. 9, the target velocity of the work point is calculated on the basis of only the arm operation signal and, in the excavation operation illustrated in FIG. 10, the target velocity of the work point is calculated on the basis of only the boom operation signal.

In accordance with the hydraulic excavator 600 according to the present embodiment having the configurations as described above, weighting is performed on each of the operation signals of the operation devices 1*c* and 1*d* such that the weight on the operation signal of the actuator having a great parallel velocity factor is 1 and the weight on the operation signals of the other actuators is 0 before the target velocity of the work point at a predetermined position on the work implement 15 (e.g., a bucket distal end) is calculated. Through the foregoing weighting, the correction according to the distance between the target surface and the work point is performed mainly on the operation signal of the actuator contributing slightly to the excavation velocity, and the correction on the operation signal of the actuator contributing greatly to the excavation velocity is suppressed, so that the operator can easily perform semi-automatic excavating shaping work at the intended excavation velocity.

It should be noted that the present invention is not limited to the above-described embodiments and may include various modifications. For example, the entire detailed configuration of the embodiments described above for ease of understanding of the present invention is not always necessary to embody the present invention. The configuration of each embodiment may additionally include another configuration, or part of the configuration may be deleted or replaced with another.

DESCRIPTION OF REFERENCE CHARACTERS

1*a*: Track right operation lever device
1*b*: Track left operation lever device
1*c*: Right operation lever device (operation device)
1*d*: Left operation lever device (operation device)
2: Hydraulic pump unit
3*b*: Track hydraulic motor
4: Swing hydraulic motor
5: Boom cylinder (actuator)
6: Arm cylinder (actuator)
7: Bucket cylinder (actuator)
8: Bucket (driven member)
9: Lower track structure (machine body)
10: Upper swing structure (machine body)
11: Boom (driven member)
12: Arm (driven member)
13*a*: First posture sensor (posture detection device)
13*b*: Second posture sensor (posture detection device)
13*c*: Third posture sensor (posture detection device)
13*d*: Machine body posture sensor (posture detection device)
14: Engine
15: Work implement
20: Control valve
100: Information processing device
110: Target surface setting section
120: Target velocity calculation section
121: Operation signal correction part
122: Work point velocity calculation part
123: Velocity factor calculation part
124: Operation signal selection part
130: Target velocity correction section
200: Control valve drive unit
500: Control system
600: Hydraulic excavator (work machine)

The invention claimed is:

1. A work machine comprising:

a machine body;

a work implement mounted rotatably on the machine body and including a plurality of driven members connected rotatably with each other;

a plurality of actuators driving the plurality of driven members;

a plurality of operation devices for operating the plurality of driven members;

a posture detection device detecting a posture of the machine body and the plurality of driven members;

a design data input device for inputting design surface information; and an information processing device controlling driving of the plurality of actuators in response to each of operation signals of the plurality of operation devices, the information processing device extracting position information of a target surface that serves as a work object from the design surface information, calculating a target velocity of a work point at a predetermined position on the work implement using each of the operation signals of the plurality of operation devices, and calculating a distance between the work point and the target surface on a basis of posture information of the plurality of driven members and position information of the target surface and correcting a velocity component of the target velocity, the velocity component being perpendicular to the target surface, according to the distance such that the work point does not penetrate the target surface, wherein the information processing device is configured to perform, before calculating the target velocity, weighting on each of the operation signals of the plurality of operation devices according to contribution to a velocity component of the work point, the velocity component being parallel to the target surface, on a basis of the posture information of the plurality of driven members and the position information of the target surface.

2. The work machine according to claim 1, wherein the information processing device is configured to calculate, on a basis of posture information of the work implement and the position information of the target surface, a parallel velocity factor that is a component of a velocity factor, the component being parallel to the target surface, the velocity factor being a ratio of the velocity of the work point to a value of an operation signal when each of the plurality of actuators is operated individually, and perform, before calculating the target velocity, weighting on each of the operation signals of the plurality of operation devices according to the parallel velocity factor.

3. The work machine according to claim 2, wherein the information processing device is configured to perform weighting on each of the operation signals of the plurality of operation devices such that a weight on an operation signal of an actuator having a maximum parallel velocity factor is 1 and weights on operation signals of other actuators are 0.

4. The work machine according to claim 1, wherein the plurality of driven members include a boom mounted at a front side of the machine body rotatably in a vertical direction, an arm connected with a distal end portion of the boom rotatably in the vertical direction or a fore-aft direction, and a bucket connected with a distal end portion of the arm rotatably in the vertical direction or the fore-aft direction, the plurality of actuators include a boom cylinder that drives the boom, an arm cylinder that drives the arm, and a bucket cylinder that drives the bucket, the plurality of operation devices include a boom operation device for operating the boom, an arm operation device for operating the arm, and a bucket operation device for operating the bucket, the work point is located at a distal end of the bucket, the position information of the target surface includes a target surface height that is a perpendicular distance from a center of rotation of the boom to the target surface and a target surface angle that is an angle of the target surface relative to an anterior direction of the machine body, and the information processing device is configured to perform weighting on each of the operation signals of the plurality of operation devices such that a weight on an operation signal of the boom operation device increases and a weight on an operation signal of the arm operation device decreases as absolute values of the target surface angle and of the target surface height increase.

* * * * *